United States Patent [19]

Zebuhr

[11] Patent Number: 4,867,654

[45] Date of Patent: Sep. 19, 1989

[54] FLUID-DRIVEN PUMP

[75] Inventor: William H. Zebuhr, Nashua, N.H.

[73] Assignee: American Thermal Corporation, Nashua, N.H.

[21] Appl. No.: 141,480

[22] Filed: Jan. 5, 1988

[51] Int. Cl.[4] ..... F04B 9/10

[52] U.S. Cl. ..... 417/393

[58] Field of Search ..... 417/393, 397

[56] References Cited

U.S. PATENT DOCUMENTS

| | | | |
|---|---|---|---|
| 3,331,330 | 7/1967 | Harklau et al. | 417/393 |
| 3,338,171 | 8/1967 | Conklin et al. | 417/393 |
| 4,609,333 | 9/1986 | Masel et al. | 417/393 |
| 4,658,760 | 4/1987 | Zebuhr | 122/13 R |

FOREIGN PATENT DOCUMENTS

| | | |
|---|---|---|
| 317578 | 11/1969 | Sweden . |
| 380325 | 11/1975 | Sweden . |

*Primary Examiner*—Leonard E. Smith

*Attorney, Agent, or Firm*—Nutter, McClennen & Fish

[57] ABSTRACT

A fluid-driven pump (10) includes a drive-inlet-valve assembly (54) that alternately directs the flow of cold pressurized water from a pressurized-water inlet (12) into alternate drive cavities (46*a* and *b*). Outlet valves (60*a* and *b*) control flow out of the drive cavities (46*a* and *b*). The resulting reciprocation of piston heads (36*a* and *b*) draws hot water in through a pump inlet (16) and out through a pump outlet (18). A valve operating mechanism driven by the piston heads' reciprocation causes both the drive outlet valves (60*a* and *b*) to close before the drive-inlet-valve assembly (54) changes its state to redirect flow of pressurized cold water from the cold-water inlet (12). The drive-inlet-valve assembly (54) is provided with a pilot-valve member that permits the drive-inlet-valve assembly (54) to be operated with a relatively low force and without introducing excessive shock and noise.

18 Claims, 4 Drawing Sheets

FLUID-DRIVEN PUMP

BACKGROUND OF THE INVENTION

The present invention is directed to fluid-driven pumps. It finds particular, although not exclusive, use in fluid-driven pumps that are employed in interposing an unpressurized reservoir in a pressurized fluid line.

U.S. Pat. No. 4,658,760 to Zebuhr describes an improvement in water heaters and other devices that must interpose a reservoir in a pressurized fluid line in order to perform some operation, such as the heating of the water. In a conventional water heater, the water is heated at line pressure, so the reservoir must take the form of a pressure vessel; the vessel must be strong enough to withstand the water pressure. In the arrangement disclosed in the Zebuhr patent mentioned above, however, the water is heated at ambient pressure so that the vessel that serves as the reservoir has to be strong enough to withstand only the pressure that results from the weight of the water. The pressure vessel can thus be much less expensive.

In order to provide a low-pressure reservoir and yet allow the pressure to remain high both upstream and downstream of the reservoir, the Zebuhr arrangement employs a fluid-driven pump. The pressure difference between the upstream section of the line and the low-pressure reservoir drives a pump that draws fluid back out of the reservoir and drives it into the downstream section of the line at high pressure. Although the Zebuhr arrangement holds out the prospect of a significant reduction in the cost of water heaters and similar devices, acceptance of water heaters that follow the teachings of the Zebuhr patent will likely depend on the ability of such water heaters to meet certain criteria.

The first criterion is that pressure reduction be minimal. The fluid-driven pump must be arranged so that the flow from the upstream line results in at least an equal flow out of the pump. Otherwise, water will accumulate in the reservoir and cause it to overflow. (Of course, the overall system must result in the same volume rate of flow in the downstream line as in the upstream line, but a slight increase in flow rate through the pump is acceptable, since arrangements can be made to return excessive flow back into the reservoir.) Since the flow rate out must at least equal the flow rate in, the law of conservation of energy dictates that the theoretical upper limit on the pressure out be the pressure in. Any inefficiencies or flow-rate gains in the pump thus result in a pressure drop. Naturally, if such pressure drops are too great, they will reduce the desirability of water heaters of this type and in fact could eliminate their feasibility in some situations.

Another second acceptance criterion is that such heaters not introduce excessive noise into the system. The pump described in the Zebuhr patent is a reciprocating device, in which valves open and close at the end of each stroke. Such openings and closings necessarily result in the generation of pressure waves that propagate through the fluid lines. Although normal opening and closing of faucets also produces pressure waves, which are thus a normal and accepted in the water lines, the pressure waves could result in annoyance if their amplitude were great enough to result in significant noise.

A third acceptance criterion is that the pump not introduce significant pressure variations; such variations could cause shower water to flow alternately hot and cold.

It is accordingly an object of the present invention to minimize pressure variations that such fluid-driven pumps introduce.

It is another object of the present invention to minimize shock and noise introduced by pumps of this sort and to maximize their efficiency so that excessive pressure losses are avoided.

SUMMARY OF THE INVENTION

The foregoing and related objects are achieved in an improvement that reduces pressure fluctuation in fluid-driven pumps of the type in which two piston heads reciprocate in respective piston housings, each of which is divided by the piston head into variable-volume drive and pump cavities. Valves control the flow of fluid from an upstream high-pressure line into the pump so that, on every other stroke, high-pressure fluid from the upstream section of the line in which the pump is interposed is admitted into the pump cavity of one of the piston housings so as to drive the piston head disposed in that housing.

While that piston head is being driven by the fluid from the high-pressure line, the drive cavity defined by the other piston head does not receive liquid from the upstream line. However, a linkage connects the two heads so that driving of one of the piston heads by the high-pressure water causes it to drive the other piston head. This causes the other piston head to move in a direction that reduces the size of its drive cavity, and a valve is operated to allow fluid to leave the drive cavity defined by the other piston head as the size of the drive cavity is reduced.

At the end of the stroke, the valving is reversed so that fluid from the upstream section of the line is admitted to the drive cavity of the other piston head so as to drive it in the other direction, while the first piston expels fluid from its drive cavity. In this way, the piston heads reciprocate and in doing so expand and contract the sizes of their respective pump cavities. The pump cavities are valved, typically by check valves, in such a manner that the expanding cavity draws fluid from a pump inlet while the contracting cavity expels fluid through the pump outlet. In short, fluid flowing through the drive cavities causes the pump to pump fluid through its pump cavities.

From the foregoing description, it can be appreciated that, at the end of the stroke (and thus at the beginning of the next stroke), a valve operates to admit fluid into one of the drive cavities, and another operates to prevent fluid from flowing into the other drive cavity; i.e., one valve opens and the other closes. The present invention greatly reduces pressure fluctuations that result from one of its sources, namely, the load placed on the pump by the valve-operating mechanism. In accordance with the present invention, the valve-operating mechanism includes an energy-storage device, typically a spring. The work performed by the incoming fluid flow to operate the valves can thus spread over nearly the entire stroke of the pump by causing the pump stroke to compress the spring. By avoiding the need to extract all of the valve-switching energy at the end of the stroke, one of the sources of pressure fluctuation is substantially eliminated.

According to another aspect of the invention, the valves operate in such a sequence that both of the valves that control flow from the upstream section of the pressure line to the drive cavities are never closed at the same time. In this way, a sudden, momentary interruption of flow, and the resultant pressure wave, are avoided.

In accordance with yet another aspect of the invention, the valves that control flow from the drive cavities are coordinated with the valves that control flow into the drive cavities in such a manner that no drive cavity's outlet valve is open, even for a very brief time, while its inlet valve is open. This coordination of the valve operation avoids any direct fluid communication from the high-pressure inlet line to what is typically a low-pressure reservoir at the outlets of the drive cavities. Avoiding such direct fluid communication further reduces pressure-pulse generation and the attendant shock and noise, and it also contributes to efficiency by insuring that all of the flow from the high-pressure inlet line to the low-pressure reservoir is used to power the pump.

The appended claims define the invention with greater specificity.

BRIEF DESCRIPTION OF THE DRAWINGS

These and further features and advantages of the invention are described in connection with the accompanying drawings, in which.

DETAILED DESCRIPTION OF THE PREFERRED EMBODIMENTS

Figure 1:
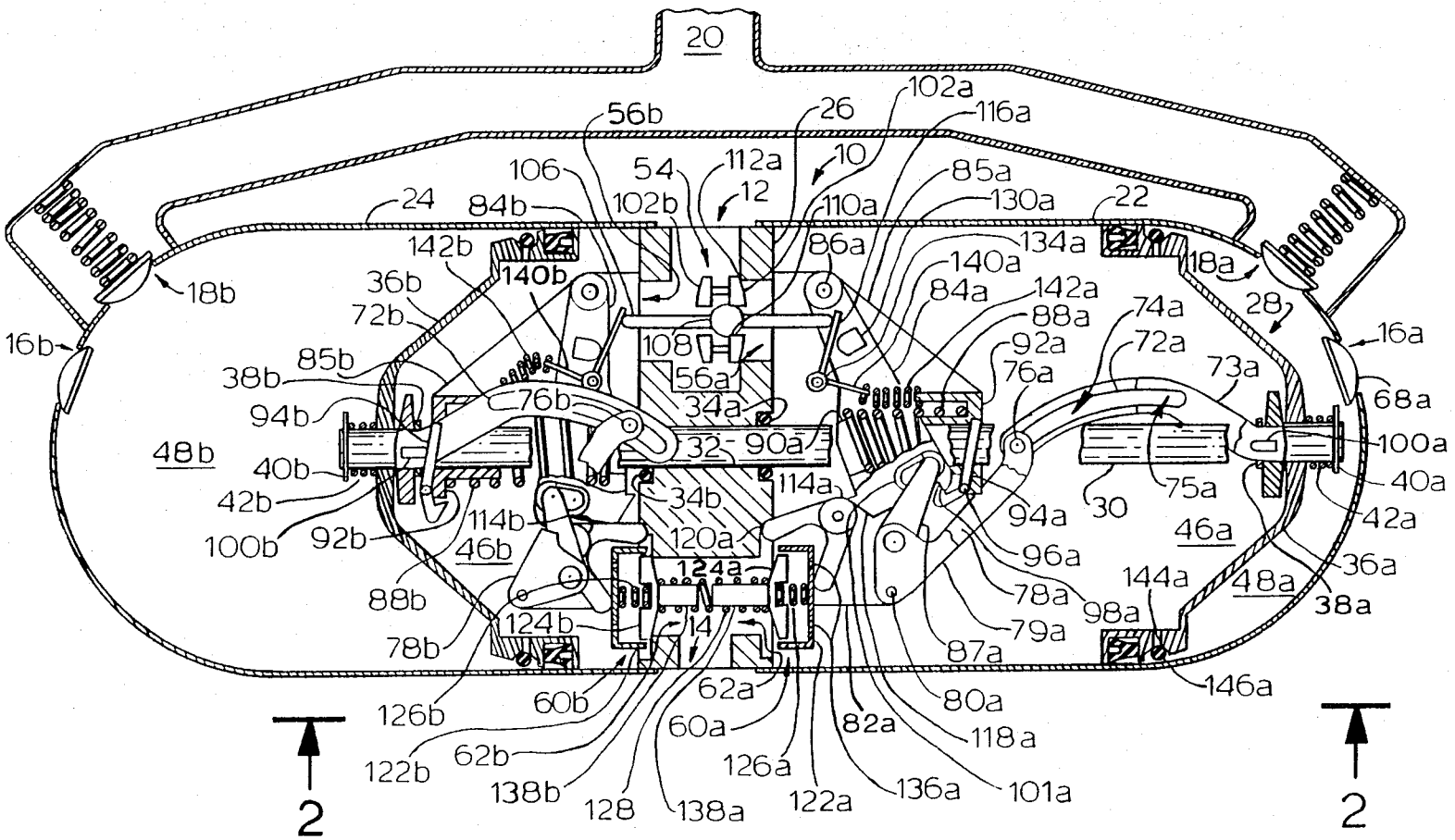
FIG. 1 is a cross-sectional view of a fluid-driven pump that incorporates the teachings of the present invention.
Figure 2:
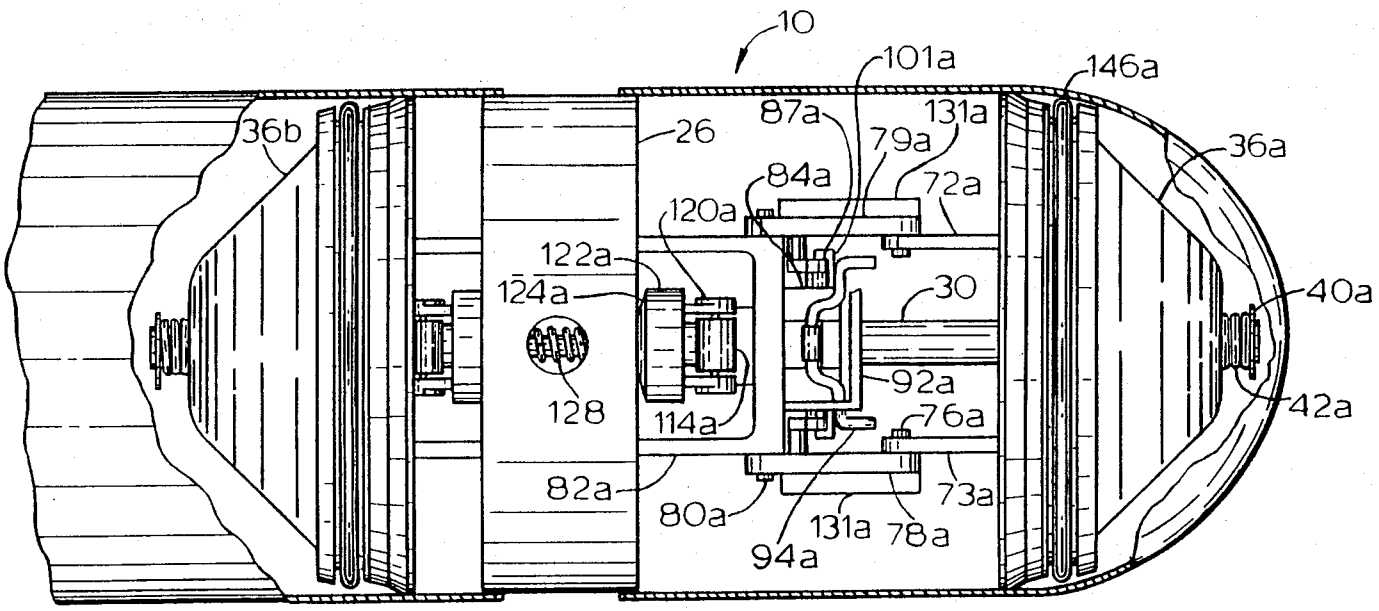
FIG. 2 is a bottom view of the same pump with part of the housing cut away.

FIGS. 1 and 2 together illustrate a fluid-driven pump 10 that has a cold-water inlet 12 and a cold-water outlet 14. As will be described in more detail below, the pump operates when the cold-water inlet 12 is connected to a source of pressurized fluid, such as an inlet water line, and the cold-water outlet 14 is connected to an unpressurized reservoir, such as the tank of an unpressurized water heater. The flow of water across this pressure difference provides the power that drives the pump. On one stroke, the pump 10 draws hot water from the tank through a pump inlet 16*a* and drives it out through a pump outlet 18*b*. On the next stroke, the pump 10 draws the water through another pump inlet 16*b* and drives it out through another pump outlet 18*a*. The water driven through outlets 18 flows into a pressurized hot-water line 20.

(Throughout the description, a reference numeral with the suffix a refers to an element on the right side, while the same numeral with the suffix b refers to the corresponding element on the left side. The same reference numeral without a suffix refers to either element.)

The pump 10 includes first and second piston housings 22 and 24, which share and are divided by a common wall 26. A piston assembly 28 includes a piston shaft 30 that extends through a bore 32 in the wall. Seals 34*a* and *b* prevent water from flowing through the bore 32.

Sealingly and slidably disposed within piston housing 22 is a piston head 36*a* slidably received on the piston shaft 30 so as to permit axial motion between two stops 38*a* and 40*a* fixed in axial position on the piston shaft 30. Although axial motion of the piston head 36*a* along the piston shaft 30 is permitted, a bias spring 42*a* biases piston head 36*a* into a position immediately adjacent stop 38*a*.

A similar piston head 36*b* is similarly disposed in the other piston housing 24 and mounted on the piston shaft 30 with similar stops 38*b* and 40*b* and a similar bias spring 42*b*.

Piston head 36*a* divides the chamber defined by piston housing 22 into a drive cavity 46*a*, into which water from the inlet line 12 is admitted in order to drive the pump, and a pump cavity 48*a*, into which hot water from the heater is drawn and from which the hot water thus drawn is driven into the hot-water line 20 by the action of the pump 10. The other piston head 36*b* similarly defines second pump and drive chambers 48*b* and 46*b*.

A drive-inlet-valve assembly 54 selectively controls fluid communication between the cold-water inlet 12 and first and second drive inlets 56*a* and *b*, by which pressurized water from the inlet line 12 is admitted into the drive cavities 46*a* and *b*, respectively. On every other stroke, the drive-inlet-valve assembly 54 is in the position shown in FIG. 1, in which it admits pressurized water into the second drive chamber 46*b* without admitting it into the first drive chamber 46*a*. On the same stroke, a first drive outlet valve 60*a* is open to permit fluid communication from the first drive chamber 46*a* through a first drive outlet 62*a* to the cold-water outlet 14, while a second drive outlet valve 60*b* is closed to prevent fluid communication between the second drive cavity 46*b* and the exhaust outlet 14 by way of a second drive outlet 62*b*.

As a result, pressurized fluid flows into the second drive cavity 46*b*, forcing piston head 36*b* to the left. Piston head 36*b* transmits its motion by way of the piston shaft 30 to the first piston head 36*a*, which therefore forces cold water from the right drive cavity 46*a* out through the right drive outlet 62*a*. The leftward motion of the first piston head 36*a* also draws hot water into the right pump cavity 48*a* through a check valve 68*a* in pump inlet 16*a*, while a check valve 18*b* in the left piston housing 24 permits hot water in the left pump cavity 48*b* to be forced into the hot-water line 20 by the leftward motion of the left piston head 36*b*.

The pressure in the left drive cavity 46*b*—which is substantially equal to the pressure in the upstream, cold-water line—is largely transmitted by the left piston head 36*b* to the left pump cavity 48*b* so that the pressure in that cavity—and thus in the downstream, hot-water line 20—is nearly, but not quite, equal to that in the upstream, cold-water line. Part of the difference between the upstream and downstream pressures arises from the minimal friction between the piston heads 36*a* and *b* and the piston housings 22 and 24, from the friction experienced by the shaft 30 in sliding through bore 32, and from any flow resistance that the moving fluid encounters. Another part of the difference results from the fact that the piston shaft 30 makes the effective drive-side surface area of piston head 36*b* less than its effective pump-side surface area. Further differences may result from pressure difference across the other piston head 36*a*, but this pressure difference is likely to be small and result largely from flow resistance because the cavities on both sides of piston head 36*a* are typically in fluid communication with the same, low-pressure reservoir.

The remainder of the difference results from the force that the shaft 30 must exert on a valve-operating mechanism in order to cock one of its actuators. The valve-operating mechanism, as will be described shortly, includes two actuators. During one stroke, the travel of the shaft 30 acts to cock one of the actuators, that is, to invest it with energy equal to the force applied to the shaft multiplied by the distance through which the shaft travels. At the end of that stroke, the shaft 30 acts to trigger the other actuator, which was cocked during the stroke that preceded the just-competed stroke. That is, the shaft cocks one of the actuators during each stroke and triggers the other actuator at the end of the stroke.

The effect is that the work that the shaft performs to operate the valves is spread over the entire stroke instead of being concentrated at its end, and a source of pressure variation thus is virtually eliminated.

Each actuator includes a slide comprising two slide arms 72 and 73, whose common outer end is secured to the shaft 30 and forms the inner stop member 38. The slide thus moves with the piston shaft 30. The slide arms 72 and 73 form elongated, curved openings 74 and 75. Opening 74 receives a pin 76 formed on the end of one arm 78 of an auxiliary lever, while opening 75 receives a similar pin 77 formed on the end of another arm 79 of the same lever. The auxiliary lever is pivotably secured with a pivot pin 80 to an extension 82 of the central wall 26.

The purpose of the slides can best be understood by reference to the righthand actuator, but both actuators operate in the same way. The slide arms 72 and 73 pull horizontally outward on the arms 78 and 79 of one of the auxiliary levers when the corresponding piston head 36 is being driven outward by the pressure introduced into the drive cavity 46 by the pressurized water from the cold-water inlet 12. The resulting pivoting of auxiliary-lever arms 78 and 79 pivots that lever about pivot pin 80. A main lever 84 is similarly pivotably mounted to another wall extension 85 by means of a pivot pin 86. The pivoting of the auxiliary lever 78 causes a link 87 to pivot the main lever 84 against the force of an actuating spring 88, which is compressed as a result between a spring stop 90 on main lever 84 and a complementary spring stop 92 on wall extension 85.

As auxiliary-lever arms 78 and 79 pivot, the angle that link 87 forms between that lever and the main lever 84 changes, and the mechanical advantage between the piston shaft 30 and the main lever 84 accordingly changes, too. This variation in mechanical advantage is chosen to correspond to the change in the force exerted by the actuator spring 88 as it is compressed. The variation in actuator force—and thus the variation in pressure reduction across the pistons—is thereby reduced.

FIGS. 1 and 2 depict the stage of the pump cycle in which the leftward stroke is just beginning. At this stage, the right valve actuator is cocked; i.e., a latch **94*a* pivotably mounted on the wall extension 85*a* by a pivot pin 96*a* is biased by a spring (not shown) into the depicted position. In the depicted position, latch 94*a* engages a catch surface 98*a* on main lever 84*a* to prevent it from pivoting clockwise under the force of actuating spring 88*a* when, during the leftward stroke, it is no longer held by link 87*a***.

This cocked condition was achieved during the preceding rightward stroke, in which the latch **94*a* started out disengaged from the main lever 84*a*, as the left latch 94*b* is in FIG. 1. As the right piston head 36*a* moved rightward, it pivoted main lever 84*a* counterclockwise, and that main lever cammed latch 94*a* counterclockwise until the latch cleared the top of the main lever 84*a* and fell into the position depicted in FIG. 1**.

With the right actuator cocked, the rightward stroke continued through a short distance to trigger the previously cocked left actuator. Specifically, the stroke continued to a position in which a trip surface **100*b* on the left-hand slide opened latch 94*b* and thereby permitted actuating spring 88*b* to drive the main lever 84*a* inward so as to cause the drive-inlet-valve assembly 54 and the drive outlet valves 60*a* and *b* to assume the position depicted in FIG. 1, as will be explained presently. When the valves assumed these positions, the left piston head 36*b* stopped its rightward motion because the left drive outlet valve 60*b* had closed to prevent flow out of the left drive cavity 46*b*. It was at that point that the left piston head 36*b* began to travel to the left. With the valves in the positions depicted in FIG. 1, the left piston head 36*b* is driven by the pressurized water from the cold-water inlet 12, which is now in fluid communication with the left drive cavity 46*b***.

During most of the rightward stroke just described, pivot pin **76*a* was held at the left end of slot 74*a* by the force transmitted from spring 88*a* through the main lever 85*a*. During the subsequent leftward stroke, however, when latch 94*a* holds the main lever 84*a* in place, the spring force is not transmitted to the auxiliary-lever arms 78*a* and 79*a*. As a consequence, pivot pin 76*a* doe not remain at the end of slot 74*a*. Instead, it slides along the slot 74*a*. As it does so, arm 78*a* pivots counterclockwise and thus causes motion of link 87*a*. Since the main lever 84*a* does not move, however, the upper end of link 87*a* slides to the left in a track 101*a* by which it is coupled to main lever 84*a*. Subsequently, when the right actuator is triggered and main lever 84*a* therefore pivots clockwise, it initially moves without corresponding motion of link 87*a* and arm 79*a* until the upper end of link 87*a* is again positioned at the upper end of trunk 101*a*. The remaining pivoting of the main lever 84*a* during valve actuation is then accompanied by movement of link 87*a* and arm 79*a* (as well as of arm 78*a*** and its link).

We now turn to the manner in which the actuators cause the valves to change state, in a sequence that is particularly beneficial to the use of the pump in domestic water heaters and similar applications. The discussion of actuator operation begins with the pump 10 in the state depicted in FIG. 1, in which the right actuator has just been cocked at the end of one stroke and is poised to reverse the valve state at the end of the next stroke, during which the left actuator will be cocked. In that state, pressurized water from the cold-water inlet line exerts pressure within the left drive cavity **46*b*. The right drive cavity 46*a*, on the other hand, is in communication with the low-pressure tank, so it is at a significantly lower pressure than the left drive cavity 46*b* is. A pressure difference thus prevails across a right input valve member 102*a*, which, together with a left input valve member 102*b*, is slidably mounted on a common valve rod 106 of the drive-inlet-valve assembly 54. A pilot-valve member 108 is secured in a fixed position on the common valve rod 106, and the pressure difference holds the pilot-valve member 108 against a pilot valve seat 110*a* provided in the right valve member 102*a*. The pressure difference also causes valve member 102*a* to be held against a valve seat 112*a***.

The pressure difference similarly holds the left drive outlet valve **60*b*** closed.

The force of the pressurized water on the left piston head 36b forces it, the piston shaft, and the right piston head to the left if water is allowed to flow in the outlet line 20. During the travel to the left, the left actuator is cocked in the manner described above in connection with the right actuator. When the piston shaft 30 has traveled far enough to the left, trip surface 100a opens latch 94a and thereby allows main lever 84a to snap clockwise in response to the force exerted by actuating spring 88a. The following section of the specification describes in detail what happens during the small fraction of a second that it takes the released main lever 84a to reverse the valve states. As it pivots counterclockwise, main lever 84a engages a cam follower 114a and a valve-operating lever 116a, which operate to reverse the states of the drive outlet valves 60a and b and the drive-inlet-valve assembly 54 in such a sequence as to prevent any direct fluid communication between the cold-water inlet 12 and the cold-water outlet 14. This contributes to pump efficiency by insuring that all of the flow from inlet 12 to outlet 14 is used in driving the pump. It also avoids the high-amplitude pressure wave and energy loss that would result if such communication suddenly occurred.

Specifically, a cam surface 118a on main lever 84a encounters cam follower 114a, which is pivotably mounted to wall extension 82a for pivoting about a pivot pin 120a. Main lever 84a causes cam follower 114a to pivot clockwise about pivot pin 120a and so push a perforated valve cap 122a to the left in FIG. 1. Valve cap 122a has a cover portion on a cylinder portion that is slidably and sealingly mounted to the periphery of a right drive outlet valve member 124a to form a piston-cylinder assembly. A spring 126a connects cap 122a to valve member 124a. The valve Cap 122a moves to the left until its rim contacts the surface of the wall 26. The sealing fit of the cap 122a and valve member 124a is good enough that the cap and valve member together prevent any significant water flow from the right drive chamber 46a to the cold-water outlet 14 even though water can flow through perforations in the cap 122a. With the valve cap 122a in the closed position, spring 126a urges valve member 124a toward its closed position, but a further spring 128, which extends between the right outlet valve member 124a and a corresponding left drive outlet valve member 124b, prevents valve member 124a from closing completely.

As soon as cap 122a has closed, the leftward motion of the right piston head 36a stops, but the flow of pressurized water through drive inlet 56b does not, so the left piston head 36b continues its motion to the left. This causes motion of the piston shaft 30 with respect to the right piston 36a against the force of the right bias spring 42a. This lost motion is recovered later, at a point at which the piston heads 36a and 36b reposition themselves under the force of their respective bias springs.

As the right main lever 84a continues to pivot clockwise, a contact 130a formed on main lever 84a forces the valve-operating lever 116a about a pivot pin 134a by which it is pivotably mounted on wall extension 85a. As a result, valve-operating lever 116a pushes pilot-valve shaft 106 to the left so as to move the pilot-valve member 108 from its pilot-valve seat 110a, where it had closed a central opening in valve member 102a. This provides a high-flow-resistance path that results in a gradual pressure increase in the right drive cavity 46a. As the pilot-valve member 108 continues to the left, it engages the other drive inlet valve member 102b, which is secured to valve member 102a so that further motion of the pilot-valve member 108 to the left would necessitate motion of the right drive inlet valve member 102a to the left. However, although the force of actuating spring 88a is great enough to overcome the force resulting from the initial pressure difference across pilot-valve member 108, it is not great enough initially to overcome the greater force resulting from the initial pressure difference across valve member 102a, which has a higher effective surface area. Accordingly, main lever 84a is stopped temporarily until the central opening in valve member 102a permits enough pressure equalization to reduce the pressure-difference force across valve member 102a to the force exerted by spring 118a.

When the hydraulic force has finally fallen to the spring force, pivoting of main lever 84a resumes, as does movement of the pilot-valve shaft 106 to the left. The further movement of the pilot-valve member 108 moves valve member 102a from its seat and valve member 102b into its seat. In this way, the right drive inlet 56a is completely opened, while the left drive inlet 56b is completely closed.

The pilot-valve arrangement has two advantages. The first is that it saves energy. If the mechanism were to open the entire valve member 102a without opening pilot-valve member 108 first, the force of spring 88a would have to be higher, so the force exerted during the cocking action would have to be higher, and less of the pressure received from the cold-water inlet line 12 would be transferred to the hot-water outlet line 20. Consequently, there would be a greater pressure drop.

The second advantage is that the shock and noise that result from the valve opening is much less than it would be if the entire valve were opened against the initial pressure difference. The shock and noise can be additionally reduced if drag wings 131 are provided on the outer ends of the arms 78 and 79 of the auxiliary lever to reduce the speed of the switching action further.

When the right drive inlet 56a has opened completely and the left drive inlet 56b has completely closed, the pressure in the right drive chamber 46a increases rapidly to the inlet pressure, and this increased pressure is transferred through openings 136a in valve cap 122a to the upper surface of valve member 124a to drive it against the force of spring 128 through the distance required to seat the right valve member 124a completely. As the right valve member travels through this distance, a valve stem 138a on the right drive outlet valve member 124a engages a corresponding valve stem 138b on the other drive outlet valve member 124b. At this point, valve member 124b has been held closed by the pressure drop across it, while valve cap 122b, although shown closed in FIG. 1, has been kept open by the force of 126b. (When the right actuator is triggered, the left piston 36b is in a position much further to the left than that illustrated in FIG. 1, so cam follower 114b does not hold cap 122b shut.) For reasons that will be explained below, valve stem 138a is able to drive valve member 124b open, but it only opens it by a small amount before valve member 124a is completely closed. The force of spring 128 is not initially great enough to open valve member 124b the rest of the way, but the pressure in the left drive cavity 46b eventually decreases enough to permit spring 128 to complete the opening of that valve member. Switching is then complete, and the piston travel reverses.

In short, the right drive outlet 62*a* was closed first, then the right drive inlet 56*a* was opened, then the left drive inlet 56*b* was closed, and the right drive outlet 62*b* was opened last.

This completes the overall operation of the pump of FIGS. 1 and 2, but certain points that have been touched only briefly admit of some elaboration. The first is the partial opening of the left drive output valve member 124*b* by its counterpart 124*a*. When valve stem 138*a* engages stem 138*b*, the pressure in the left drive cavity 46*a* may be just as high as that in the right drive cavity 46, but valve member 128*a* can still open valve member 128*b*. The reason for this is that the resultant hydraulic force applied to valve member 124*a* is higher than that applied to valve member 124*b*. Specifically, valve cap 122*a* is sealed against wall 26 and the peripheral surface of valve member 124*a* so that the effective area over which the high pressure is applied to the right valve member 124*a* is that of its entire face. On the other hand, the force resulting from the pressure on the part of the face of the left valve member 124*b* peripherally outward of its seat is canceled because cap 122*b* is not sealed against the wall 26.

From this description, one might question why the cap 122 has only small perforations 136; in principle, the cap 122 could simply be a cylindrical sleeve, since the perforations 136 permit pressure from the drive chamber 46 into the cap interior. The answer is that making the perforations small is another way of slowing the switching action and thus reducing shock and noise. The small perforations cause flow resistance so that the pressure inside the cap 122 required to close valve member 122 is sustained only if the motion of the valve member is relatively slow.

Another point that admits of elaboration is the use of spring 128 to complete the opening of the drive outlet valve member. As was stated above, the initial opening motion of valve member 124*b* is caused by hydraulic force on member 124*a*. Hydraulic force is used because the initial motion requires a high force, but the pump is designed so that the distance over which the hydraulic force is applied is kept very short, because the fluid flow that goes into opening the valve cannot be used to pump water from the reservoir; i.e., it detracts from the flow-rate gain of the pump. Therefore, a spring 128 opens the valve member the rest of the way.

This brings up a further point of elaboration, namely, the flow-rate gain of the pump. As was just mentioned, not all of the flow into the drive cavities is reflected in flow out of the pump cavities. But it is a requirement of the use of pump 10 in an unpressurized water heater that the volume rate of flow of the hot water out of the pump be at least as high as that of the cold water into it. Indeed, if the water volume flow rate of the hot water is not greater than that of the cold water, thermal expansion in the reservoir will cause the water level to increase steadily. Pump 10 meets this requirement despite the flow lost in closing and opening valve members 124*a* and 124*b* because the presence of the shaft 30 in the drive cavities 46*a* and 46*b* results in a lower displacement per unit piston travel in the drive cavities than in the pump cavities.

We now turn to a description of a right-angle actuating-lever extension 140 and a spring 142 that loads it. The foregoing discussion of FIGS. 1 and 2 is based on the assumption that a source of high-pressure water is always in communication with the cold-water inlet, and the resultant pressure holds the valves in their respective positions. However, if pressure were removed from this inlet, the drive-inlet-valve assembly 54 could assume a position in which neither drive inlet is closed if spring 142 and extension 140 were not provided. This could make restarting the pump difficult.

In order to prevent this situation, the extension 140 is loaded by spring 142, which in turn is secured to wall extension 82. When the drive-inlet-valve assembly 54 is in the position depicted in FIG. 1, in which the right drive inlet 56 is closed, extension 140*a* is disposed at such an angle that its spring 142*a* exerts no significant torque on actuating lever 116*a*, but spring 142*b* does exert torque on actuating lever 116*b* so as to bias the drive-inlet-valve assembly 54 into the position shown in FIG. 1. When the drive-inlet-valve assembly 54 is in the other position, the positions of springs 142*a* and 142*b* are reversed so as to bias the drive-inlet-valve assembly 54 in the other position. In this way, removal of pressure does not allow the drive-inlet-valve assembly 54 to assume a position in which neither drive inlet is closed. With closure of the drive-inlet-valve assembly assured, the pump 10 operates correctly when inlet pressure is re-applied, because the drive outlet valves 60*a* and *b* assume their proper positions under the force of water flow.

The final point of elaboration is that the piston heads 36*a* and *b* do not have to be especially strong. The piston heads 36*a* and *b* are not themselves subjected to a force any greater than that which they apply to the actuators; with the exception of this force, all of the hydraulic force applied on one side of the piston head is normally balanced by the force on the other side. Furthermore, in order to insure that no unusual situations cause significantly higher forces, openings 144 near the peripheries of the pistons are provided, and these openings are sealed by resilient O-rings 146. If an excessive pressure difference occurs across the piston head, O-rings 146 will be displaced resiliently from their seats and thus allow water flow through the openings 144 to reduce the pressure difference.

Figure 3:
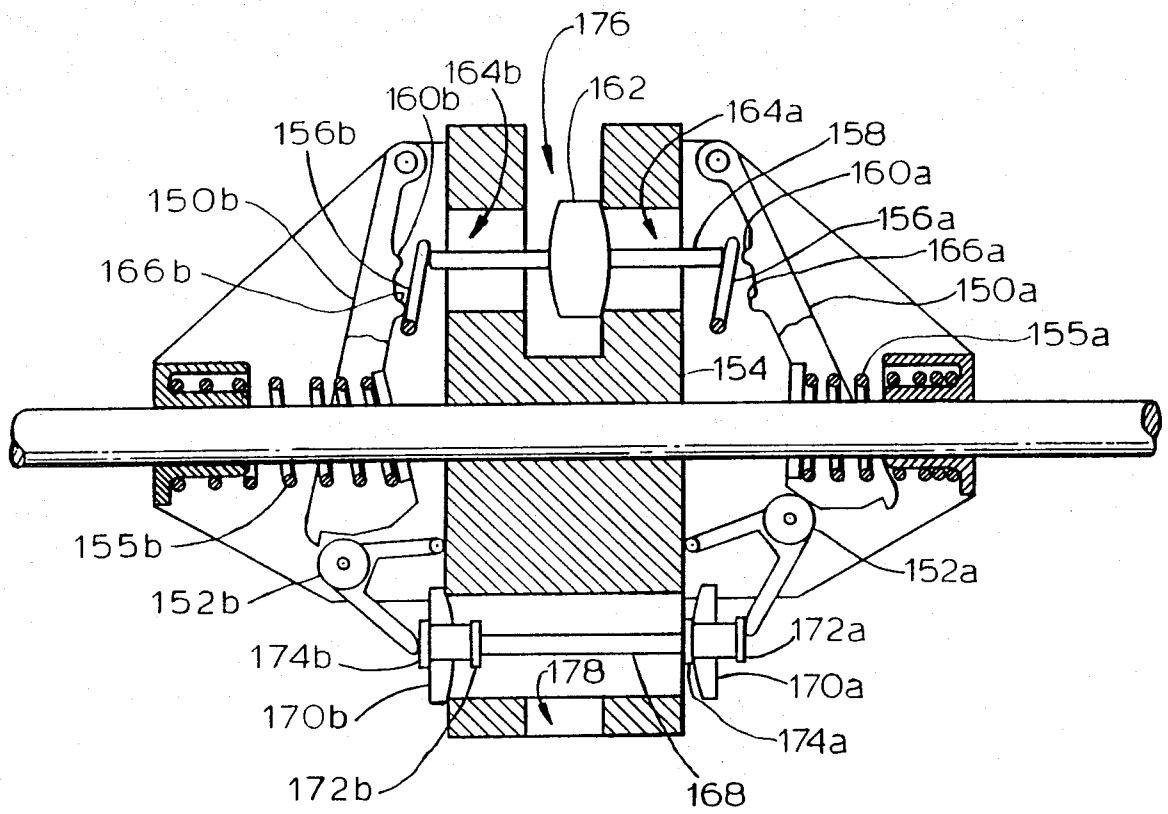
FIG. 3 is a diagrammatic rendering of an alternate embodiment of the present invention.

FIG. 3 diagrammatically depicts an alternate, simpler embodiment of the present invention. Like the arrangements of FIGS. 1 and 2, that of FIG. 3 includes a main lever 150, a cam follower 152 operated by the main lever when the lever is pivoted toward the wall 154 by a spring 155, and an actuating lever 156 that operates a valve shaft 158 when the actuating lever 156 is initially engaged by a contact 160 on the main lever 150. In the arrangement of FIG. 3, however, the valve shaft 158 has a main-valve member 162 secured to it, not a pilot-valve member. The main-valve member 162 operates between two positions, in which it closes respective drive inlets 164*a* and *b*.

In the arrangement of FIG. 1, a pilot valve was employed so that the initial opening force would be relatively low due to the small effective surface area of the pilot valve member 108 and so that the noise and shock would be minimized because the high flow resistance resulting from the smallness of the pilot opening would prevent a high-amplitude pressure pulse. In the arrangement of FIG. 3, the high flow resistance is achieved by opening the main inlet valve member 162 by only a small amount initially. The initial opening force is high, but it is overcome by an initially high mechanical advantage.

Specifically, as the main lever 150 in FIG. 3 pivots, it first begins operation of a drive-outlet-valve assembly, as will be described below, and a contact 160 on the main lever 150 then contacts actuating lever 156 at the end opposite its pivot point so as to apply a relatively high force to the piston shaft 158. This causes the main valve member 162 to open, but at a low rate due to the location of contact 160 relatively near to the pivot point of main lever 150.

When the main valve member 162 has opened by a small amount, the contact point between the main lever 150 and the actuating lever 156 changes to a new contact 166, which is farther from the pivot point of the main lever 150 and much closer to the pivot point of the actuating lever 156. Consequently, the force exerted on the piston shaft 158 is much lower, and it is not initially enough to continue moving inlet valve member 162 against the pressure difference that initially prevails across it. As the pressure builds up in the drive chamber, however, the pressure difference decreases, and the spring eventually overcomes the hydraulic force on the valve member 162 and moves the valve member 162 to its other state.

The inlet-valve operation just described begins after operation of the drive-outlet-valve assembly has started. In the arrangement of FIG. 3, the drive-outlet-valve assembly includes a single valve shaft 168 and two valve members 170*a* and 170*b*. Each valve member 170 is allowed to slide axially with respect to the valve shaft 168 through a limited travel defined by stops 172 and 174.

The operation will be described with the actuators starting in the positions shown in FIG. 3. When the right main lever 150*a* is unlatched and begins pivoting clockwise, it first engages cam follower 152*a*, which urges the outlet valve shaft 168 to the left. This causes the right outlet valve member 170*a* to move to the left with the shaft, but the left outlet valve member 170*b* is held in its seat by the pressure difference that prevails across it. The cam follower 152*a* must overcome hydraulic force on the valve shaft 168 that results from the pressure difference between the drive cavities, but spring 155 applies enough spring force to overcome the hydraulic force, so it closes valve member 170*a* into its seat When valve member 170*a* reaches its seat and thus closes the outlet of the right-hand pump cavity, pressure in that cavity begins to build. At the same time, travel of the main lever 150*a* continues through a region in which the contour of the cam surface of the main lever 150*a* is such that little further travel of the outlet valve shaft 168 occurs. During this time, both drive outlets are closed by their respective valve members 170*a* and 170*b*, contact 160*a* on main lever 150*a* engages actuating lever 166*a*, and the drive inlet valves switch as was described above.

Toward the end of the travel of the inlet-valve member 162, movement of the outlet valve shaft 168 begins again, and stop 172*b* engages outlet valve member 170*b* and opens it. The spring 155*a* that drives the main lever 150*a* must act against the hydraulic force holding valve 170*b* closed, but it is aided in doing so by the fact that the pressure in the right drive cavity has increased to nearly that in the left drive cavity so as to reduce the hydraulic force significantly.

It will be appreciated by a review of the foregoing discussion of FIG. 3 that there is a short period of time in which a direct path exists between the pressurized-water inlet 176 and the exhaust outlet 178. Although such a direct route is not desirable, since it results in lost fluid flow and lost energy, the effect of this direct path is minimal, since it exists for only a short time and only while the flow resistance offered by this direct path is very great.

As was described above, the displacement per unit travel in the drive cavities is less than that in the pump cavities, and this overcomes flow losses in the actuating mechanism and in addition provides a margin for thermal expansion. Therefore, the output flow of the pump 10 is slightly greater than the input flow. This would tend to cause the water level in the heater tank to drop if some provision were not made to avoid such a result.

Figure 4:
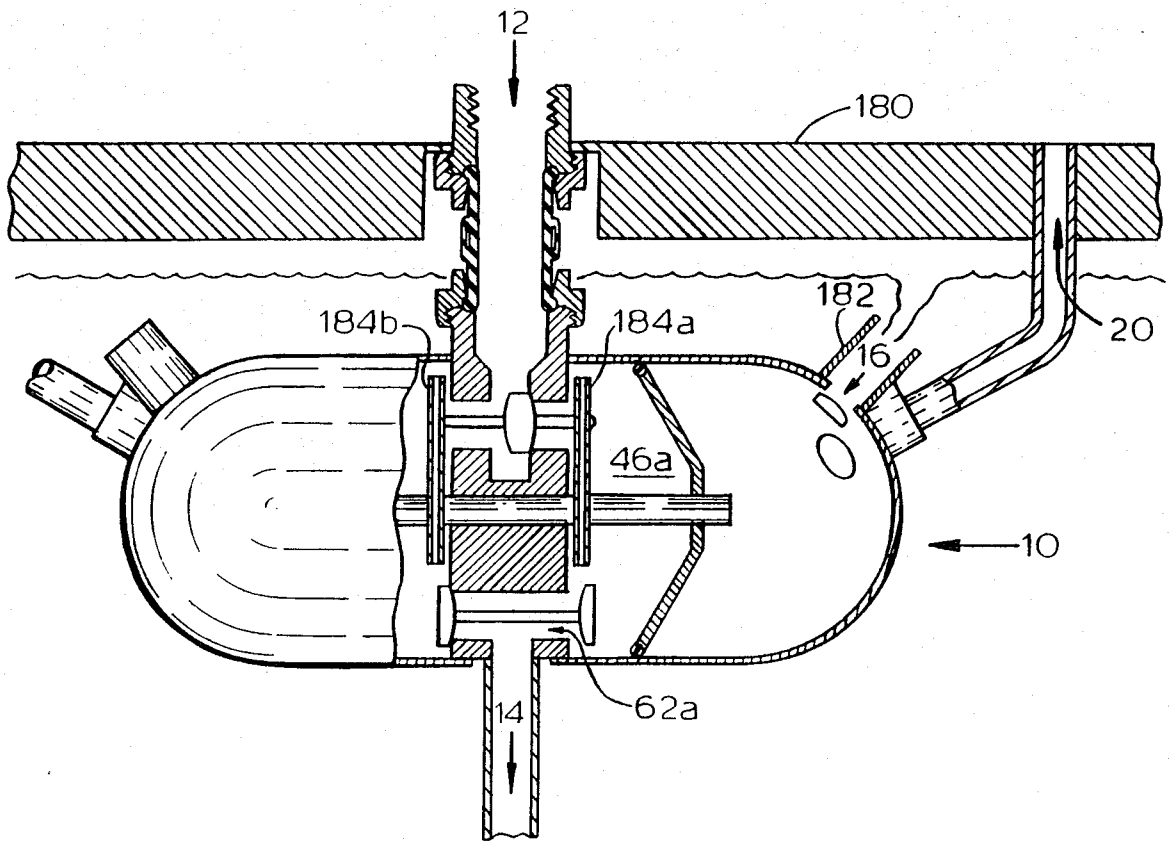
FIG. 4 is a diagrammatic rendering of a pump of the present invention disposed in a low-pressure tank in such a way that the water level in the tank remains constant.

FIG. 4 illustrates the mechanism for maintaining the water in the vessel at a predetermined level. FIG. 4 depicts the pump 10 in the interior of a tank having a cover 180 that provides the cold-water inlet 12. In operation, the pressurized cold water introduced through inlet 12 drives the pump 10 and is exhausted through the exhaust outlet 14 into the tank. There the water is heated, and the flow of the cold water through the pump 10 causes it to draw hot water through inlet 16 and pump it through the hot-water outlet line 20.

To maintain the desired water level, a pipe 182 is provided at the pump inlet 16. This pipe 182 extends to the desired water level. When the pump operates with the pipe 182 completely covered so that it draws in only water and no air, the gain of the pump is such as to cause it to draw in more hot water from the tank than is replenished from the pump's cold-water outlet 14. Consequently, the water level falls to the point at which the pump draws in some air, which the pump expels with the hot water that it pumps out through line 20. This reduces the effective gain of the pump so that the water level tends to rise and re-immerse the pipe 182. Since the fall in water level results in a gain increase, while an increase in water level results in a gain decrease, a stable water level results without the use of any special level-sensing devices.

FIG. 4 also illustrates diagrammatically a pair of tubes 184*a* and 184*b* that were omitted from FIGS. 1–3 for the sake of simplicity. Tube 184 extends from the top of its pump chamber 46 to the region of the drive outlet valves, and their purpose is to remove air that may collect in the pump cavities. When water is forced out through the drive outlet, its relatively high velocity causes low pressure in the outlet region due to the Venturi effect, and that low pressure causes any air at the top of a tube 184 to be drawn through the tube to the drive outlet.

By employing the teachings of the present invention, the advantages of a reciprocating fluid-driven pump can be achieved with high efficiency and without excessive noise production and pressure variation. The invention therefore constitutes a significant advance in the art.

I claim:

1. A fluid-driven pump comprising:

A. first and second piston housings defining first and second piston chambers, respectively, and respective first and second drive and pump inlets and outlets that provide communication between their respective piston chambers and the exterior of the piston housings;

B. a piston assembly comprising:

i. first and second piston heads associated with the first and second piston chambers, respectively, the first and second piston heads being sealingly and slidably disposed in their respective associated piston chambers to divide their respective associated piston chambers into respective first and second variable-volume pump cavities, into which the respective first and second pump inlets and outlets provide fluid communication, and respective first and second variable-volume drive cavities, into which the respective first and second drive inlets and outlets provide fluid communication; and ii. piston linkage means linking the first and second piston heads so as to urge each of the piston heads to slide in the direction in which it increases the volume of its associated pump cavity when the other piston head is driven to slide in the direction in which it increases the volume of its associated drive cavity;

c. drive inlet value means, adapted for connection to a pressurized inlet line, for selectively providing fluid communication between the inlet line and the first and second drive inlets, the drive inlet valve means being operable between a first state, in which it directs fluid from the inlet line to the first drive inlet and prevents it from flowing from the inlet line to the second drive inlet, and a second state, in which it directs fluid from the inlet line to the second drive inlet and prevents to from flowing form the inlet line to the first drive inlet;

D. drive outlet valve means, operable between first and second states, for preventing fluid from flowing out through the first drive outlet but permitting fluid flow out of the second drive cavity through the second drive outlet when the drive outlet valve means is in its first state and preventing fluid from flowing out through the second drive outlet but permitting fluid flow out of the first drive cavity through the first drive outlet when the drive outlet valve means is in its second state; and E. valve operating means for operating the drive inlet and outlet valve means from their respective second states to their respective first states when the piston heads have reached a predetermined first position, in which the first pump cavity has reached a relatively high volume and the second pump cavity has reached a relatively low volume, and for operating the control inlet and outlet valves from their respective first states to their respective second states when the piston heads have reached a predetermined second position, in which the first pump cavity has reached a relatively low volume and the second pump cavity has reached a relatively high volume, the valve-operating means comprising:

i. first and second actuators operable by application of energy thereto to operate the drive inlet and outlet valve means to their first and second states, respectively;

ii. first and second springs, deflectable by application of force thereto, for exerting force when the spring means is deflected; and iii. first and second cock-and-trigger mechanisms operatively connected to the piston assembly and to the first and second springs and actuators, respectively, for selectively transmitting force (i) between the first and second springs, respectively, and the piston assembly as the piston heads travel from the first and second positions, respectively, of the piston assembly to the second and first positions, respectively, thereof so that the piston heads travel from the first position of the piston assembly to the second position thereof against the force transmitted from the first spring and thereby store energy in the first spring by deflecting it and so that the piston heads travel from the second position of the piston assembly to the first position thereof against the force transmitted from the second spring and thereby store energy in the second spring by deflecting it and (ii) between the first and second springs and the first and second actuators, respectively, when the piston assembly reaches its first and second positions, respectively, so as to cause the actuators to change the states of the drive inlet and outlet valve means, the first and second cock-and-trigger mechanisms further including first and second latch means, respectively, associated with the first and second springs and actuators, respectively, and having cocked and triggered states, for preventing transmission of force from the springs to the actuators in their cocked states and for permitting transmission of force from the springs to the actuators in their triggered states, the first latch means being so formed and positioned with respect to the piston assembly and the first actuator as (i) to assume its cocked state when the piston assembly reaches a predetermined cocking position in its travel form the first position to the second position and (ii) to assume its triggered state when the piston assembly reaches its first position, the second latch means being so formed and positioned with respect to the piston assembly and the second actuator as (i) to assume its cocked state when the piston assembly reaches a predetermined cocking position in its travel from the second position to the first position and (ii) to assume its triggered state when the piston assembly reaches its second position so that the spring means expends in changing the states of the drive inlet and outlet valve means the energy sorted therein during the travel of the piston heads;

F. pump inlet valve means for preventing fluid flow from each pump cavity through hits pump inlet when the piston head associated with that pump cavity is sliding in the direction in which it reduces the volume of that pump cavity and for permitting fluid flow into each pump cavity through is pump inlet when the piston head associated with that pump cavity is sliding in the direction in which it increases the volume of that pump cavity; and G. pump outlet valve means for permitting flow from each pump cavity through its pump outlet when the piston head associated with that pump cavity is sliding in the direction in which it reduces the volume of that pump cavity and for preventing fluid flow into each pump cavity through its pump outlet when the piston head associated with that pump cavity is sliding in the direction in which it increases the volume of that pump cavity, whereby the piston heads tend to reciprocate between their first and second positions, and thereby draw fluid in and pump it out the pump inlets and outlets, respectively, when the drive inlet valve means is connected to as high-pressure line.

2. A fluid-driven pump as defined in claim 1 wherein:

A. the forces exerted by the springs increase with increases in the deflections of the springs; and B. the cock-and-trigger mechanisms transmit force between the springs and the piston assembly with mechanical advantages that vary with the positions of the piston heads and are complementary to the force variations of the springs so that the relative variations in the forces transmitted by the cock-and-trigger mechanisms to the piston assembly are less than those in the forces exerted by the springs on the cock-and-trigger mechanisms.

3. A fluid-driven pump comprising:

A. First and second piston housings defining first and second piston chambers, respectively, and respective first and second drive and pump inlets and outlets that provide communication between their respective piston chambers and the exterior of the piston housings;

B. a piston assembly comprising:

i. first and second piston heads associated with the first and second piston chambers, respectively, the first and second piston chambers, being sealingly and slidably disposed in their respective associated piston chambers to divide their respective associated piston chambers into respective first and second variable-volume pump cavities, into which the respective first and second pump inlets and outlets provide fluid communication, and respective first and second variable-volume drive cavities, into which the respective first and second drive inlets and outlets provide fluid communication; and ii. piston linkage means linking the first and second piston heads so as to urge each of the piston heads to slide in the direction in which it increases the volume of its associated pump cavity when the other piston head is driven to slide in the direction in which it increases the volume of its associated drive cavity;

C. drive inlet valve means, adapted or connection to a pressurized inlet line, for selectively providing fluid communication between the inlet line and the first and second drive inlets, the drive inlet value means being operable between a first state, in which it directs fluid from the inlet line to the first drive inlet and prevents it from flowing from the inlet line to the second drive inlet, and a second state, in which it directs fluid from the inlet line to the second drive inlet and prevents it from flowing from the inlet line to the first drive inlet;

D. drive outlet valve means, operable between first and second states, for preventing fluid from flowing out through the first drive outlet but permitting fluid flow out of the second drive cavity through the second drive outlet when the drive outlet valve means is in its first state and preventing fluid from flowing out through the second drive outlet but permitting fluid flow out of the first drive cavity through the first drive outlet when the drive outlet valve means is in its second state; and E. valve operating means for operating the drive inlet and outlet valve means from their respective second states to their respective first states when the piston heads have reached a predetermined first position, in which the first pump cavity has reached a relatively high volume and the second pump cavity has reached a relatively low volume, and for operating the control inlet and outlet values form their respective first states to their respective second states when the piston heads have reached a predetermined second position, in which the first pump cavity has reached a relatively low volume and the second pump cavity has reached a relatively high volume, the valve-operating means comprising:

i. actuating means operable by application of energy thereto to operate the drive inlet and outlet valve means selectively to their first and second states; and ii. spring means, deflectable by application of force thereto, for exerting force when the spring means is deflected that increases with the deflection of the spring means;

iii. first force-transmission means operatively connected between the spring means and the piston assembly for transmitting force therebetween as the piston heads travel between the first and second positions of the piston assembly with a mechanical advantage that varies with the positions of the piston heads and is complementary to the force variation of the spring means so that the relative variation in the force transferred by the force-transmission means to the piston assembly is less than that in the force exerted by the spring means on the force-transmission means, whereby the piston heads travel against the force transmitted form the spring means and thereby store energy in the heads travel; and iv. second force-transmission means operatively connected between the spring means and the actuating means for transmitting force therebetween when the piston assembly reaches its first and second positions so that the spring means expends in changing the states of the drive inlet and outlet valve means the energy stored therein during the travel of the piston heads;

F. pump inlet valve means for preventing fluid flow from each pump cavity through its pump inlet when the piston head associated with that pump cavity is sliding in the direction in which it reduces the volume of that pump cavity and for permitting fluid flow into each pump cavity through its pump inlet when the piston head associated with that pump cavity is sliding in the direction in which it increases the volume of that pump cavity; and G. pump outlet valve means for permitting flow from each pump cavity through its pump outlet when the piston head associated with that pump cavity is sliding in the direction in which it reduces the volume of that pump cavity and for preventing fluid flow into each pump cavity through its pump outlet when the piston head associated with that pump cavity is sliding in the direction in which it increases the volume of that pump cavity, whereby the piston heads tend to reciprocate between their first and second positions, and thereby draw fluid in and pump it out the pump inlets and outlets, respectively, when the drive inlet valve means is connected to a high-pressure line.

4. A fluid-driven pump comprising:

A. first and second piston housings defining first and second piston chambers, respectively, and respective first and second drive and pump inlets and outlets that provide communication between their respective piston chambers and the exterior of the piston housings;

B. a piston assembly comprising:

i. first and second piston heads associated with the first and second piston chambers, respectively, the first and second piston heads being sealingly and slidably disposed in their respective associated piston chambers to divide their respective associated piston chambers into respective first and second variable-volume pump cavities, into which the respective first and second pump inlets and outlets provide fluid communication, and respective first and second variable-volume drive cavities, into which the respective first and second drive inlets and outlets provide fluid communication; and ii. piston linkage means linking the first and second piston heads so as to urge each of the piston heads to slide in the direction in which it increases the volume of its associated pump cavity when the other piston head is driven to slide in the direction in which it increases the volume of its associated drive cavity;

C. drive inlet valve means, adapted for connection to a pressurized inlet line, for selectively providing fluid communication between the inlet line and the first and second drive inlets, the drive inlet valve means being operable through a range of positions between a first state, in which it directs fluid from the inlet line to the first drive inlet and prevents it from flowing from the inlet line to the second drive inlet, and a second state, in which it directs fluid from the inlet line to the second drive inlet and prevents it from flowing from the inlet line to the first drive inlet, the drive inlet valve means providing fluid communication between the pressurized inlet line and at least one of the drive chambers throughout the range of positions including an intermediate range in which both of the drive inlets are open;

D. drive outlet valve means, operable between first and second states, for closing the first drive outlet but permitting fluid flow out of the second drive cavity through the second drive outlet when the drive outlet valve means is in its first state and closing the second drive outlet but permitting fluid flow out of the first drive cavity through the first drive outlet when the drive outlet valve means is in its second state; and E. valve operating means for operating the drive inlet and outlet valve means from their respective second states to their respective first states when the piston heads have reached a predetermined first position, in which the first pump cavity has reached a relatively high volume and the second pump cavity has reached a relatively low volume, and for operating the control inlet and outlet valves from their respective first states to their respective second states when the piston heads have reached a predetermined second position, in which the first pump cavity has reached a relatively low volume and the second pump cavity has reached a relatively high volume, the valve operating means, in operating the drive inlet and outlet valve means between their first and second states, operating the drive outlet valve means to an intermediate state, between the first and second states, in which the drive outlet valve means prevents fluid flow through both the first and the second drive outlets before the drive outlets means operates the drive inlet valve means to the intermediate range thereof, the valve operating means maintaining the drive outlet valve means in its intermediate state until after the valve operating means has operated the drive inlet valve means through its intermediate range, whereby the valve operating means prevents a direct fluid path between either drive inlet and either drive outlet while it is operating the drive inlet and outlet means between their first and second states;

F. pump inlet valve means for preventing fluid flow from each pump cavity through its pump inlet when the piston head associated with that pump cavity is sliding in the direction in which it reduces the volume of that pump cavity and for permitting fluid flow into each pump cavity through its pump inlet when the piston head associated with that pump cavity is sliding in the direction in which it increases the volume of that pump cavity; and G. pump outlet valve means for permitting flow from each pump cavity through its pump outlet when the piston head associated with that pump cavity is sliding in the direction in which it reduces the volume of that pump cavity and for preventing fluid flow into each pump cavity through its pump outlet when the piston head associated with that pump cavity is sliding in the direction in which it increases the volume of that pump cavity, whereby the piston heads tend to reciprocate between their first and second positions, and thereby draw fluid in and pump it out the pump inlets and outlets, respectively, when the drive inlet valve means is connected to a high-pressure line.

5. A fluid-driven pump as defined in claim 4 wherein the piston linkage means comprises a piston shaft to which the piston heads are resiliently secured so as to permit limited relative motion between the two piston heads.

6. A fluid-driven pump:

A. first and second piston housings defining first and second piston chambers, respectively, and respective first and second drive and pump inlets and outlets that provide communication between their respective piston chambers and the exterior of the piston housings;

B. a piston assembly comprising:

i. first and second piston heads associated with the first and second piston chambers, respectively, the first and second piston heads being sealingly and slidably disposed in their respective associated piston chambers to divide their respective associated piston chambers into respective first and second variable-volume pump cavities, into which the respective first and second pump inlets and outlets provide fluid communication, and respective first and second variable-volume drive cavities, into which the respective first and second drive inlets and outlets provide fluid communication; and ii. piston linkage means linking the first and second piston heads so as to urge each of the piston heads to slide in the direction in which it increases the volume of its associated pump cavity when the other piston head is driven to slide in the direction in which it increases the volume of its associated drive cavity;

C. drive inlet valve means, adapted for connection to a pressurized inlet line, for selectively providing fluid communication between the inlet line and the first and second drive inlets, the drive inlet valve means being operable between a first state, in which it directs fluid from the inlet line to the first drive inlet and prevents it from flowing from the inlet line to the second drive inlet, and a second state, in which it directs fluid from the inlet line to the second drive inlet and prevents it from flowing from the inlet line to the first drive inlet;

D. drive outlet valve means, operable between first and second states, for closing the first drive outlet but permitting fluid flow out of the second drive cavity through the second drive outlet when the drive outlet valve means is in its first state and closing the second drive outlet but permitting fluid flow out of the first drive cavity through the first drive outlet when the drive outlet valve means is in its second state, the drive outlet valve means including first and second valve caps that include cylinder portions, the drive outlet valve means further including first and second drive outlet valve members associated with the first and second valve caps, drive cavities, piston housings, and drive outlets, respectively, each drive outlet valve member being translatable within its associated cylinder portion between an open position, in which it is spaced from its respective piston housing to define a drive outlet valve opening for fluid flow from its associated drive cavity through its associated drive outlet to the exterior of its associated piston housing, and a closed position, in which it (i) seals against its associated piston housing to prevent fluid communication between its associated drive cavity through its associated drive outlet to the exterior of its associated piston housing, (ii) is subjected to the pressure that prevails at the exterior of its associated drive outlet over an outlet effective area, and (iii) is so positioned with respect to the drive outlet valve member included in the other drive outlet valve means as to prevent the other drive outlet valve member from assuming its closed position, the cylinder portion of each valve cap being sealingly and slidably mounted on its associated drive outlet valve member to form therewith a piston-cylinder assembly in which the drive outlet valve member acts as a piston to divide the interior of the cylinder portion into cavity-side and outlet-side cap chambers having a cylinder bore greater than the outlet effective area, each cap being translatable between (i) a closed position, in which its cylindrical portion seals against the associated piston housing to prevent fluid communication between its associated drive cavity and the outlet-side cap chamber and thereby between its associated drive chamber and its associated drive outlet valve opening when the associated drive outlet valve member is in its open position and (ii) an open position, in which it permits fluid communication between its associated drive chamber and its associated drive outlet valve opening when the associated drive outlet valve member is in its open position; and E. valve operating means for operating the drive inlet and outlet valve means from their respective second states to their respective first states when the piston heads have reached a predetermined first position, in which the first pump cavity has reached a relatively high volume and the second pump cavity has reached a relatively low volume, and for operating the control inlet and outlet valves from their respective first states to their respective second states when the piston heads have reached a predetermined second position, in which the first pump cavity has reached a relatively low volume and the second pump cavity has reached a relatively high volume, the valve operating means operating the drive outlet valve means from its first state to its second state by operating the second valve cap to its closed position while the first valve cap is in its open position so that the second drive outlet valve member is subjected to the pressure difference between the second drive cavity and the exterior of the second drive outlet over its entire bore area while the first drive outlet valve member is subjected to the pressure difference between the first drive cavity and the exterior of the first drive outlet over only the effective outlet area so that equal pressure differences between the first and second drive cavities and the exteriors of the first and second drive outlets tend to force the second drive outlet valve member into its closed position and in doing so to open the first drive outlet valve member, the valve operating means operating the drive outlet valve means from its second state to its first state by operating the first valve cap to its closed position while the second valve cap is in its open position so that the first drive outlet valve member is subjected to the pressure difference between the first drive cavity and the exterior of the first drive outlet over its entire bore area while the second drive outlet valve member is subjected to the pressure difference between the second drive cavity and the exterior of the second drive outlet over only the effective outlet area so that equal pressure differences between the first and second drive cavities and the exteriors of the first and second drive outlets tend to force the first drive outlet valve member into its closed position and in doing so to open the second drive outlet valve member;

F. pump inlet valve means for preventing fluid flow from each pump cavity through its pump inlet when the piston head associated with that pump cavity is sliding in the direction in which it reduces the volume of that pump cavity and for permitting fluid flow into each pump cavity through its pump inlet when the piston head associated with that pump cavity is sliding in the direction in which it increases the volume of that pump cavity; and G. pump outlet valve means for permitting flow from each pump cavity through its pump outlet when the piston head associated with that pump cavity is sliding in the direction in which it reduces the volume of that pump cavity and for preventing fluid flow into each pump cavity through its pump outlet when the piston head associated with that pump cavity is sliding in the direction in which it increases the volume of that pump cavity, whereby the piston heads tend to reciprocate between their first and second positions, and thereby draw fluid in and pump it out the pump inlets and outlets, respectively, when the drive inlet valve means is connected to a high-pressure line.

7. A fluid-driven pump as defined in claim 6 wherein each valve cap further includes a cover portion positioned on the cylinder portion of that valve cap so as generally to close the cavity-side cap chamber, the cover portion being perforated to allow low-flow-rate fluid communication between the cavity-side cap chamber and the associated drive cavity.

8. A fluid-driven pump comprising:

A. first and second piston housings defining first and second piston chambers, respectively, and respective first and second drive and pump inlets and outlets that provide communication between their respective piston chambers and the exterior of the piston housings;

B. a piston assembly comprising:

i. first and second piston heads associated with the first and second piston chambers, respectively, the first and second piston heads being sealingly and slidably disposed in their respective associated piston chambers to divide their respective associated piston chambers into respective first and second variable-volume pump cavities, into which the respective first and second pump inlets and outlets provide fluid communication, and respective first and second variable-volume drive cavities, into which the respective first and second drive inlets and outlets provide fluid communication; and ii. piston linkage means linking the first and second piston heads so as to urge each of the piston heads to slide in the direction in which it increases the volume of its associated pump cavity when the other piston head is driven to slide in the direction in which it increases the volume of its associated drive cavity;

C. drive inlet valve means, adapted for connection to a pressurized inlet line, for selectively providing fluid communication between the inlet line and the first and second drive inlets, the drive inlet valve means being operable between a first state, in which it directs fluid from the inlet line to the first drive inlet with relatively low flow resistance and prevents it from flowing from the inlet line to the second drive inlet, and a second state, in which it directs fluid from the inlet line to the second drive inlet with relatively low flow resistance and prevents it from flowing from the inlet line to the first drive inlet, the drive inlet valve means further being operable to first and second intermediate states, in which it permits fluid flow through the first and second drive inlets, respectively, with relatively high flow resistance;

D. drive outlet valve means, operable between first and second states, for closing the first drive outlet but permitting fluid flow out of the second drive cavity through the second drive outlet when the drive outlet valve means is in its first state and closing the second drive outlet but permitting fluid flow out of the first drive cavity through the first drive outlet when the drive outlet valve means is in its second state; and E. valve operating means for, (i) when the piston heads have reached a predetermined first position, in which the first pump cavity has reached a relatively high volume and the second pump cavity has reached a relatively low volume, operating the drive outlet valve means from its second state to its first state and operating the drive inlet valve means from its second state to its first intermediate state, maintaining it in its first intermediate state until the pressure difference across the first inlet falls below a predetermined value, and then operating it to its second state and, (ii) when the piston heads have reached a predetermined second position, in which the first pump cavity has reached a relatively low volume and the second pump cavity has reached a relatively high volume, operating the drive outlet valve means from its first state to its second state and operating the drive inlet valve means from its first state to its second intermediate state, maintaining it in its second intermediate state until the pressure difference across the second inlet falls below a predetermined value, and then operating it to its first state;

F. pump inlet valve means for preventing fluid flow from each pump cavity through its pump inlet when the piston head associated with that pump cavity is sliding in the direction in which it reduces the volume of that pump cavity and for permitting fluid flow into each pump cavity through its pump inlet when the piston head associated with that pump cavity is sliding in the direction in which it increases the volume of that pump cavity; and G. pump outlet valve means for permitting flow from each pump cavity through its pump outlet when the piston head associated with that pump cavity is sliding in the direction in which it reduces the volume of that pump cavity and for preventing fluid flow into each pump cavity through its pump outlet when the piston head associated with that pump cavity is sliding in the direction in which it increases the volume of that pump cavity, whereby the piston heads tend to reciprocate between their first and second positions, and thereby draw fluid in and pump it out the pump inlets and outlets, respectively, when the drive inlet valve means is connected to a high-pressure line.

9. A fluid-driven pump as defined in claim 8 wherein:

A. the drive inlet valve means comprises first and second drive inlet valves, the first and second drive inlet valves comprising first and second main valve and pilot valve members and providing respective first and second main and pilot valve seats therefor;

B. in the first state of the drive inlet valve means, the first main and pilot valve members are spaced from the first main and pilot valve seats and the second main and pilot valve members are seated in the second main and pilot valve seats;

C. in the second state of the drive inlet valve means, the first main and pilot valve members are seated in the first main and pilot valve seats and the second main and pilot valve members are spaced from the second main and pilot valve seats;

D. in the first intermediate state of the drive inlet valve means, the first main valve member is seated in the first main valve seat, the first pilot valve member is spaced from the first pilot valve seat, and the second main valve is spaced from the second main valve seat; and E. in the second intermediate state of the drive inlet valve means, the second main valve member is seated in the second main valve seat, the second pilot valve member is spaced from the second pilot valve seat, and the first main valve is spaced from the first main valve seat.

10. A fluid-driven pump as defined in claim 9 wherein the first and second main valve members form first and second valve-member apertures that extend through the first and second main valve members, respectively, and define the first and second pilot valve seats.

11. A fluid-driven pump as defined in claim 10 wherein:

A. the drive inlet valve means includes a common valve shaft extending through the first and second valve-member apertures to permit relative axial movement between the common valve shaft and the main valve members;

B. each of the first and second pilot valve members is secured to the valve shaft at a fixed position thereon, travel of the valve shaft in a first direction moving the first pilot valve member to seat it in the first pilot valve seat and urge the first main valve member toward the first main valve seat, travel of the valve shaft in a second direction moving the second pilot valve member to seat it in the second pilot valve seat and urge the second main valve member toward the second main valve seat;

C. the drive inlet valve means includes means for maintaining the first and second main valve members in fixed relative positions such that the surfaces thereon that engage the main valve seats are spaced from each other by less than the distance between the main valve seats so that travel of the valve shaft in one direction to seat one of the main valve members in its main valve seat causes the other main valve member to be removed from its main valve seat.

12. A fluid-driven pump as defined in claim 11 wherein the first and second pilot valve members are the same.

13. A fluid-driven pump as defined in claim 8 wherein the drive inlet valve means comprises first and second drive inlet valves operable between respective fully open positions, which they occupy in the first and second states, respectively, of the drive inlet valve means and in which they permit fluid flow from the inlet line to the first and second drive inlets, respectively, and respective closed positions, which they occupy in the second and first states, respectively, of the drive inlet valve means and in which they prevent fluid flow from the inlet line to the first and second drive inlets, respectively, each drive inlet valve being so arranged that, when the pressure in its respective drive cavity is lower than that in the inlet line, the pressure difference across the drive inlet valve exerts a force that resists opening movement of the valve, the closed and fully open positions being separated by a predetermined range of travel, and the first and second drive inlet valves being further operable to respective intermediate positions, which the first and second drive inlet valves occupy when the drive inlet valve means is in its first and second intermediate states, respectively, and which are separated from the respective closed positions of the first and second drive inlet valves by a fraction of the predetermined range of travel.

14. A fluid-driven pump comprising:

A. first and second piston housings defining first and second piston chambers, respectively, and respective first and second drive and pump inlets and outlets that provide communication between their respective piston chambers and the exterior of the piston housings;

B. a piston assembly comprising:

i. first and second piston heads associated with the first and second piston chambers, respectively, the first and second piston heads being sealingly and slidably disposed in their respective associated piston chambers to divide their respective associated piston chambers into respective first and second variable-volume pump cavities, into which the respective first and second pump inlets and outlets provide fluid communication, and respective first and second variable-volume drive cavities, into which the respective first and second drive inlets and outlets provide fluid communication; and ii. piston linkage means linking the first and second piston heads so as to urge each of the piston heads to slide in the direction in which it increases the volume of its associated pump cavity when the other piston head is driven to slide in the direction in which it increases the volume of its associated drive cavity;

C. drive inlet valve means, adapted for connection to a pressurized inlet line, for selectively providing fluid communication between the inlet line and the first and second drive inlets, the drive inlet valve means including first and second drive inlet valves operable between respective fully open positions, in which they permit fluid flow from the inlet line to the first and second drive inlets, respectively, and respective closed positions, in which they prevent fluid flow from the inlet line to the first and second drive inlets and in which, when the pressure in its respective drive cavity is lower than that in the inlet line, the pressure difference across the drive inlet valve exerts a force that resists opening movement of the valve, the closed and fully open positions being separated by a predetermined range of travel, and the first and second drive inlet valves being further operable to respective intermediate positions separated from their respective closed positions by a fraction of the predetermined range of travel;

D. drive outlet valve means, operable between first and second states, for closing the first drive outlet but permitting fluid flow out of the second drive cavity through the second drive outlet when the drive outlet valve means is in its first state and closing the second drive outlet but permitting fluid flow out of the first drive cavity through the first drive outlet when the drive outlet valve means is in its second state; and E. valve operating means for, (i) when the piston heads have reached a predetermined first position, in which the first pump cavity has reached a relatively high volume and the second pump cavity has reached a relatively low volume, operating the drive outlet valve means from its second state to its first state, operating the second drive inlet valve from its fully open position to its closed position and the first drive inlet valve from its closed position to its intermediate position, maintaining the first drive inlet valve in its intermediate position until the pressure difference across the first inlet falls below a predetermined value, and then operating the first drive inlet valve to its fully open position and, (ii) when the piston heads have reached a predetermined second position, in which the first pump cavity has reached a relatively low volume and the second pump cavity has reached a relatively high volume, operating the drive outlet valve means from its first state to its second state, operating the first drive inlet valve from its fully open position to its closed position and the second drive inlet valve from its closed position to its intermediate position, maintaining the second drive inlet valve in its intermediate position until the pressure difference across th second inlet falls below a predetermined value, and then operating the second drive inlet valve to its fully open position;

F. pump inlet valve means for preventing fluid flow from each pump cavity through its pump inlet when the piston head associated with that pump cavity is sliding in the direction in which it reduces the volume of that pump cavity and for permitting fluid flow into each pump cavity through its pump inlet when the piston head associated with that pump cavity is sliding in the direction in which it increases the volume of that pump cavity; and G. pump outlet valve means for permitting flow from each pump cavity through its pump outlet when the piston head associated with that pump cavity is sliding in the direction in which it reduces the volume of that pump cavity and for preventing fluid flow into each pump cavity through its pump outlet when the piston head associated with that pump cavity is sliding in the direction in which it increases the volume of that pump cavity, whereby the piston heads tend to reciprocate between their first and second positions, and thereby draw fluid in and pump it out the pump inlets and outlets, respectively, when the drive inlet valve means is connected to a high-pressure line.

15. A fluid-driven pump as defined in claim 14 wherein:

A. the drive inlet valve means comprises first and second drive inlet valves, the first and second drive inlet valves comprising first and second main valve and pilot valve members and providing respective first and second main and pilot valve seats therefor;

B. in the first state of the drive inlet valve means, the first main and pilot valve members are spaced from the first main and pilot valve seats and the second main and pilot valve members are seated in the second main and pilot valve seats;

C. in the second state of the drive inlet valve means, the first main and pilot valve members are seated in the first main and pilot valve seats and the second main and pilot valve members are spaced from the second main and pilot valve seats;

D. in the first intermediate state of the drive inlet valve means, the first main valve member is seated in the first main valve seat, the first pilot valve member is spaced from the first pilot valve seat, and the second main valve is spaced from the second main valve seat; and E. in the second intermediate state of the drive inlet valve means, the second main valve member is seated in the second main valve seat, the second pilot valve member is spaced from the second pilot valve seat, and the first main valve is spaced from the first main valve seat.

16. A fluid-driven pump as defined in claim 15 wherein the first and second main valve members form first and second valve-member apertures that extend through the first and second main valve members, respectively, and define the first and second pilot valve seats.

17. A fluid-driven pump as defined in claim 16 wherein:

A. the drive inlet valve means includes a common valve shaft extending through the first sand second valve-member apertures to permit relative axial movement between the common valve shafts and the main valve members;

B. each of the first and second pilot valve members is secured to the valve shaft at a fixed position thereon, travel of the valve shaft in a first direction moving the first pilot valve member to seat it in the first pilot valve seat and urge the first main valve member toward the first main valve seat, travel of the valve shaft in a second direction moving the second pilot valve member to seat it in the second pilot valve seat and urge the second main valve member toward the second main valve seat;

C. the drive inlet valve means includes means for maintaining the first and second main valve members in fixed relative positions such that the surfaces thereon that engage the main valve seats are spaced from each other by less than the distance between the main valve seats so that travel of the valve shaft in one direction to seat one of the main valve members in its main valve seat causes the other main valve member to be removed from its main valve seat.

18. A fluid-driven pump as defined in claim 17 wherein the first and second pilot valve members are the same.

* * * * *